United States Patent [19]

Brenner

[11] Patent Number: 4,642,908

[45] Date of Patent: Feb. 17, 1987

[54] ADDITIVE DISPENSER FOR CLOTHES DRYER

[75] Inventor: Robert A. Brenner, St. Joseph Township, Berrien County, Mich.

[73] Assignee: Whirlpool Corporation, Benton Harbor, Mich.

[21] Appl. No.: 727,886

[22] Filed: Apr. 26, 1985

[51] Int. Cl.[4] ..... F26B 11/04

[52] U.S. Cl. ..... 34/60; 68/17 R; 118/267

[58] Field of Search ..... 68/17 R; 118/266, 267; 34/60, 133

[56] References Cited

U.S. PATENT DOCUMENTS

| | | | |
|---|---|---|---|
| 2,958,954 | 11/1960 | Longenecker | 34/60 |
| 3,053,222 | 9/1962 | Brierley et al. | 118/267 |
| 3,392,884 | 7/1968 | Waldrum . | |
| 3,613,959 | 10/1971 | Mason . | |
| 3,749,288 | 7/1973 | Wade . | |
| 3,914,805 | 10/1975 | Dolan . | |
| 4,004,685 | 1/1977 | Mizuno et al. . | |
| 4,009,598 | 3/1977 | Bernard et al. . | |
| 4,139,475 | 2/1979 | Schwadtke et al. . | |

*Primary Examiner*—Larry I. Schwartz

*Attorney, Agent, or Firm*—Hill, Van Santen, Steadman & Simpson

[57] ABSTRACT

A fluid additive dispenser is provided for a clothes dryer which has a reservoir for storing a quantity of liquid additive, a body of porous material acting as a wick and having a first surface exposed to the tumbling clothes load within the dryer and a second surface for receiving the fluid additive, a conduit connecting the reservoir with the second surface of the material and a valve interposed within the conduit which is selectably operable to deliver a predetermined quantity of liquid to the second surface of the porous material. The reservoir has a horizontal cross section greater than the horizontal cross section of the conduit and is positioned above the valve to provide a relatively constant fluid head to the valve to assist in the accurate metering of the fluid through the valve. The porous material is held in a holder which is mounted to a fixed rear bulkhead of the drum.

18 Claims, 9 Drawing Figures

FIG.1
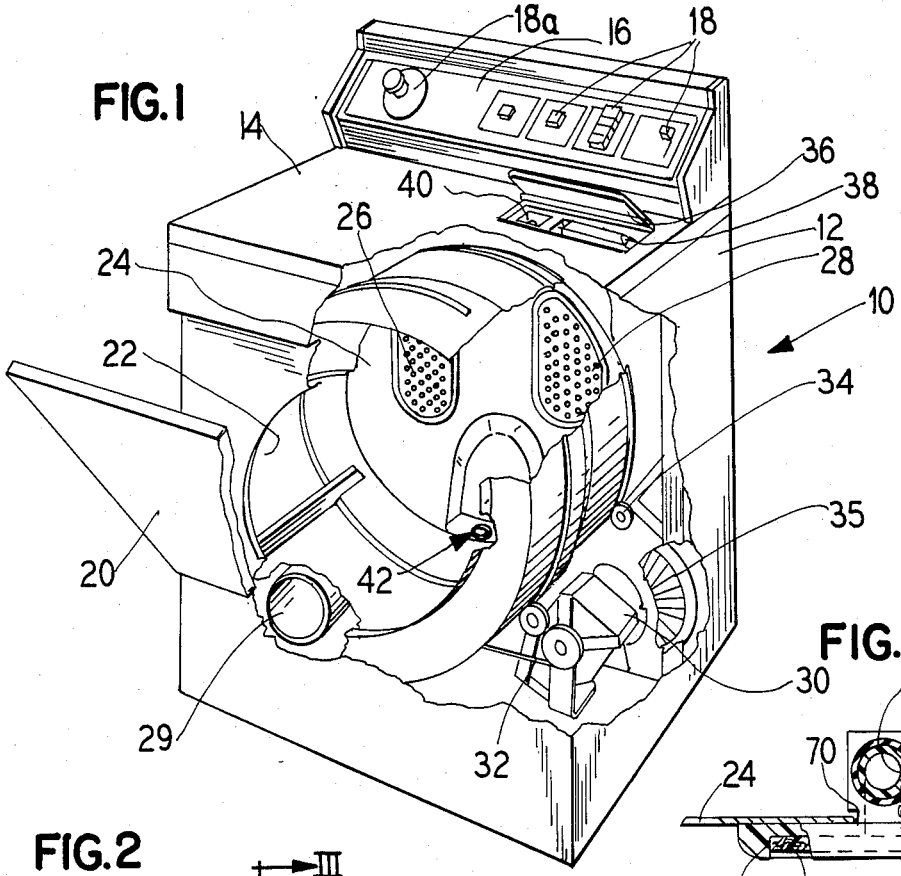
FIG.5
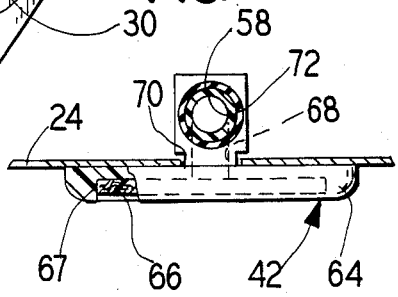
FIG.2
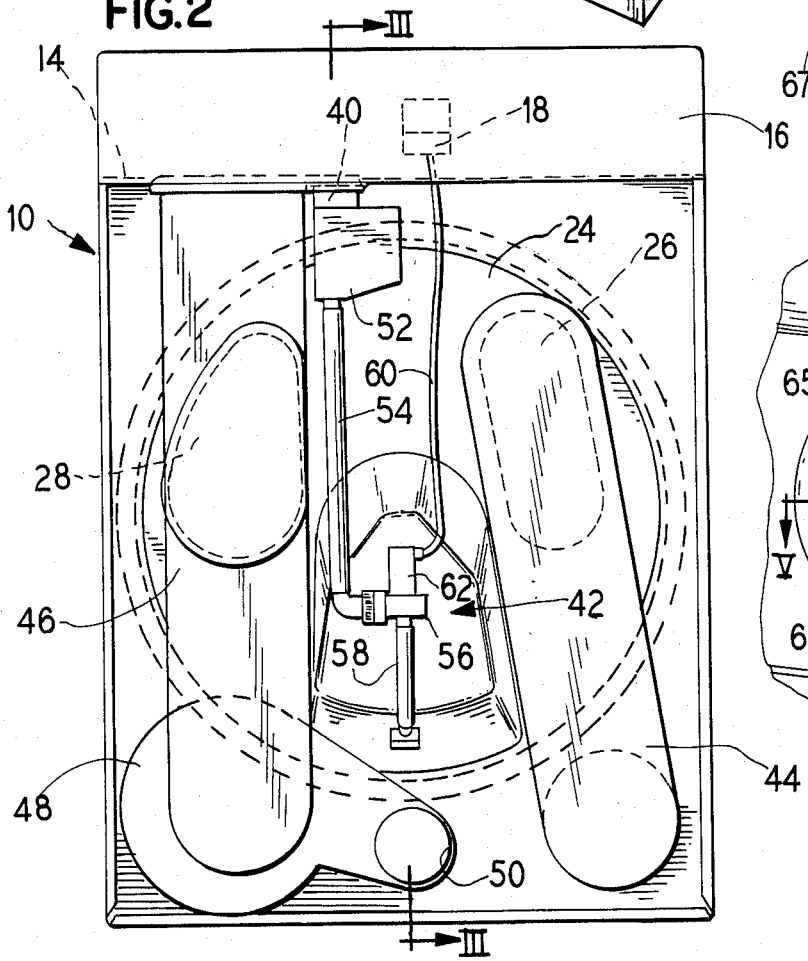
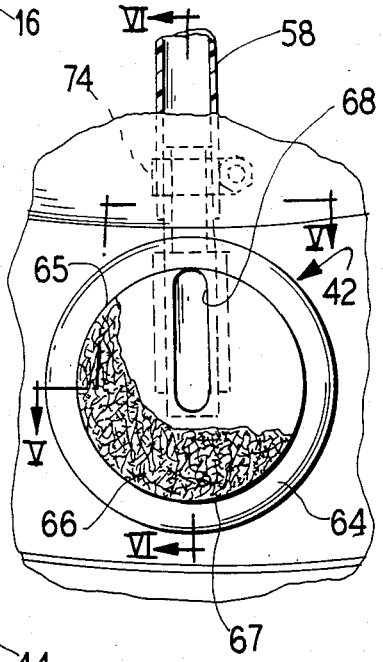
FIG.4

ADDITIVE DISPENSER FOR CLOTHES DRYER

BACKGROUND OF THE INVENTION

1. Field of the Invention

The present invention relates to automatic clothes dryers and more particularly to an automatic additive dispenser for a clothes dryer.

2. Description of the Prior Art

In the normal course of utilization of an automatic clothes dryer, it is becoming common to use various additives to reduce or prevent static build-up in the clothes, to soften the clothes and even to apply a scent to the clothes. Various methods have been developed for applying such additives to the clothes load within the dryer, all of which require the placement of an article within the interior of the dryer drum which contains the additive to be dispensed, or the direct spraying of the additive into the dryer drum.

For example, sheets of paper or fabric are available which contain anti-static and softening additives which are designed to be placed in the dryer drum along with the clothes load being dried. U.S. Pat. No. 4,139,475 discloses the use of a package containing a laundry finishing treatment agent which is to be tumbled with the clothes load within the dryer. U.S. Pat. No. 4,004,685 discloses a fabric softener and antistatic agent dispenser for a dryer which is formed into a bar of material which softens at the temperatures normally experienced within the dryer during a drying operation. The bar of conditioning agent is encased in a cloth envelope, and the envelope is mounted to a portion of the dryer drum that rotates with the clothes load.

A disadvantage with the prior methods of applying additives to a clothes load within a dryer is that either a separate charge has to be manually admitted to the interior of the dryer drum for each load, as by introducing new sheets impregnated with additives, or the dispenser in the dryer drum has to be checked periodically to determine if sufficient additive remains which involves locating the dispenser within the drum and somehow determining the amount of additive yet available in the dispenser.

SUMMARY OF THE INVENTION

An object of the present invention is to provide a clothes dryer with means for automatically applying an anti-static and/or fabric softener or other fluid additive to the clothes load during a drying operation. More specifically, it is an object of the invention to provide such a fabric conditioner dispenser which requires only infrequent attention by the user and which obviates the need for expensive metering valves and flow control structures such as are often associated with fluid dispensers. It is a further object of the invention to provide a fabric conditioner dispenser which has a means for readily recharging the amount of additive without requiring the user to locate and act upon a dispenser contained within the drum.

The dispenser of the present invention comprises a holder mounted on a rear non-rotating bulkhead of the dryer drum. A wick is mounted in the holder with one surface exposed on the interior of the dryer drum and a second surface being selectively exposed through a valve to a reservoir holding the fluid additive. The reservoir is filled through a receptacle that is located on a top panel of the dryer for easy access.

At the start of a dry cycle, the valve will be automatically momentarily opened, allowing a measured amount of fluid to flow to the wick. During the dry cycle, the clothes tumble across the wick absorbing the additive held by the wick.

BRIEF DESCRIPTION OF THE DRAWINGS

FIG. 1 is a perspective view of an automatic clothes dryer embodying the principles of the present invention.

FIG. 2 is a rear elevational view of the dryer of FIG. 1.

FIG. 4 is an elevational view of the wick holder taken generally along the line IV—IV of FIG. 3.

FIG. 5 is a sectional view of the dispenser taken generally along the line V—V of FIG. 4.

DESCRIPTION OF THE PREFERRED EMBODIMENTS

Figure 3:
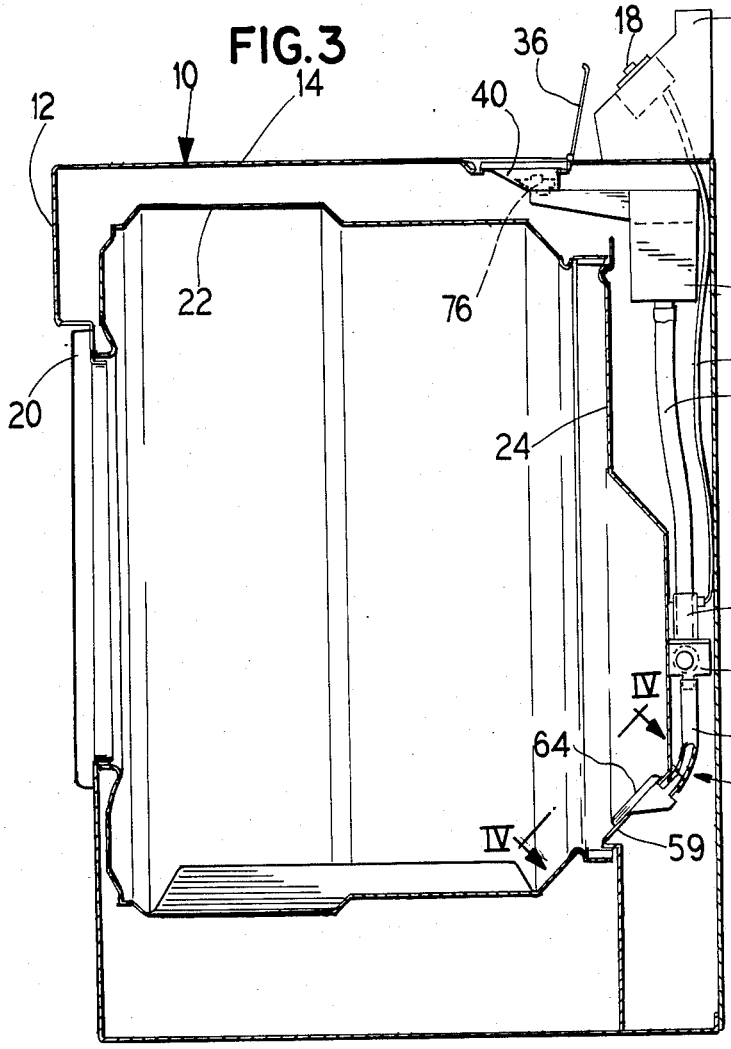
FIG. 3 is a side sectional view taken generally along the line III—III of FIG. 2.

In FIG. 1, there is generally shown an automatic clothes dryer at 10 having an exterior cabinet 12 with a top panel 14 having a control console 16 along a rear portion thereof incorporating a plurality of controls 18 for selecting an automatic programmed series of drying steps. The dryer cabinet 12 has a front openable door 20 providing access to the interior of a rotatable drying drum 22 which rotates about a horizontal axis and has a non-rotating rear bulkhead 24 with air inlets 26 and air outlets 28 therein for charging the interior of the drum 22 with heated air from a heater 29 and for exhausting moisture laden air. An electric motor 30 is provided to rotate the drum 22 through a pulley arrangement 32, the drum rotating on a plurality of rollers 34. The motor 30 also drives a fan 35 which provides the air flow through the interior of the drum.

Accessible through an openable lid 36 in the top panel 14 is a lint screen 38 and a receptacle 40 for receiving a supply of fluid additive to be dispensed into the interior of the drum 22. A dispenser shown generally at 42 for the fluid additive is mounted to the rear bulkhead 24.

FIG. 2 is a rear view of the dryer 10 of FIG. 1 with a rear cabinet panel removed to expose the rear bulkhead 24 of the dryer drum. FIG. 3 is a side sectional view of the interior of the dryer with the blower and air flow components not shown, so that the dispenser structure can be seen more clearly. An air duct 44 is shown in FIG. 2 which carries heated air from the heater to the air inlet openings 26 in the rear bulkhead, and a separate duct 46 is provided for carrying moisture laden air from the air outlet 28 in the rear bulkhead to a fan housing 48 to be discharged through an outlet port 50. The duct 46 for the moisture laden air extends upwardly to the top panel 14 so that it can receive the lint screen 38. The receptacle 40 for receiving the fluid additive is shown in FIGS. 2 and 3 and is positioned directly above a reservoir 52 which is designed to hold a large supply of fluid additive. Extending downwardly from a low portion of the reservoir 52 is a fluid conduit 54. The conduit 54 communicates with a metering valve 56. A second fluid conduit 58 extends downwardly from the metering valve 56 and is attached to the portion of the additive dispenser 42 that is mounted on the bulkhead 24. It is shown in FIG. 3 that the bulkhead 24 has an inwardly sloped lower portion 59 to which the dispenser portion is mounted. A pair of electrical wires 60 are shown to be extending from a solenoid 62 attached to the metering valve 56, the wires extending up to one of the controls 18 on the dryer console 16.

Figure 6:
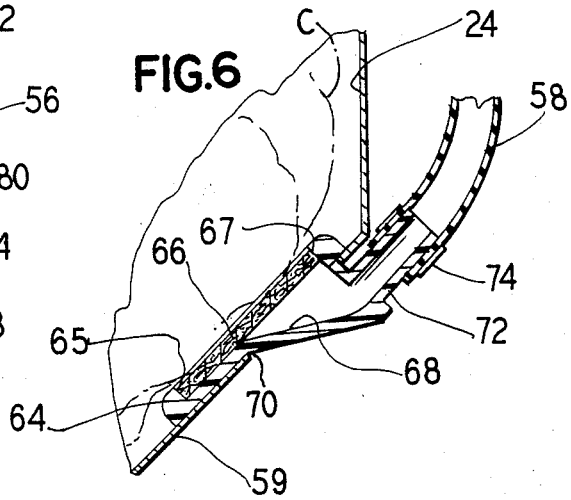
FIG. 6 is a sectional view of the dispenser taken generally along the line VI—VI of FIG. 4.

The dispenser 42 is shown in greater details in FIGS. 4, 5 and 6 where it is seen that the dispenser comprises a circular holder 64 which is positioned on the interior side of the bulkhead 24 on the sloped portion 59, the holder having a large front opening 65 carrying a circular wick-like member 66 which is formed of a porous material.

The construction of the wick-like member 66 is important to successful operation of the dispenser 42, because it controls the rate at which the liquid additive is applied to the clothes load. After some experimentation, the Applicant found that a body of wool felt approximately $\frac{1}{8}''$ thick and 2" in diameter provides good dispensing performance. Some materials, such as a polyester felt, tend to disintegrate after relatively short periods of use, due to abrasion by the clothes load (particularly buckles, zippers, etc.). Experimentation has also shown that the body of wick-like material works best if it is made up of relatively long fibers, as opposed to short fiber material. As seen in FIG. 5, the wick member 66 is recessed slightly within the holder 64 to provide protection for a peripheral edge 67 of the wick against abrasion by the clothes load.

The dispenser 42, being mounted on the inwardly sloping portion 59 of the bulkhead is readily contacted by a clothes load C which tumbles within the drum. It has been found that the best results of transferring the additive from the wick to the clothes load occurs while the clothes are still damp. Therefore, the metering of the additive through the valve should preferably occur at or near the beginning of the drying cycle.

The holder 64 has a relatively smaller opening 68 in a portion thereof which extends through an opening 70 in the bulkhead 24. The opening 68 communicates with the conduit 58 which slips over a neck portion 72 of the holder 42 and can be secured in place by an appropriate restraining strap 74.

Figure 7:
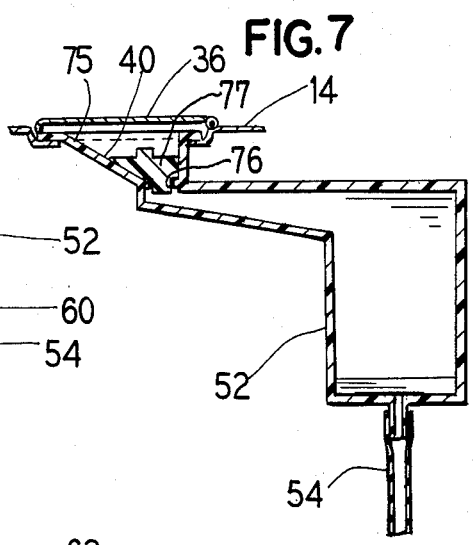
FIG. 7 is a sectional view of the reservoir and receptacle.
Figure 8:
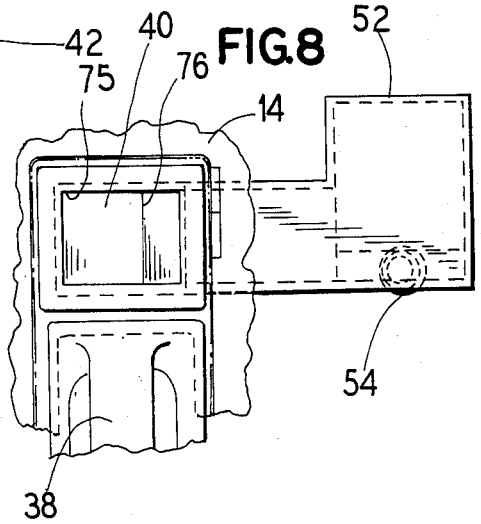
FIG. 8 is a partial plan view of the receptacle lid area.

FIGS. 7 and 8 show in detail the filling receptacle 40 and reservoir 52 which are used to fill and hold the fluid additive to be dispensed. Although these figures are not necessarily drawn to scale, it can be understood that the volume and horizontal cross section of the reservoir 52 is large compared with the conduit 54, as shown in FIG. 8, such that a relatively constant fluid head is maintained at the metering valve 56. The need for a relatively constant fluid head is critical so that a desired amount of additive can be dispensed to the wick 66 by opening the valve 56 a predetermined length of time.

The filling receptacle 40 compresses a relatively large opening 75 in the top panel 14 to assist in easy filling of the reservoir. A user can readily determine when the reservoir 52 has been filled in that a neck portion 76 is provided between the filling receptacle 40 and the reservoir 52, at a full level of the reservoir, which is clearly visible when the access lid 36 is opened. As shown in FIG. 7, a removable cap or plug 77 can be used to seal the neck portion 76 between the filling receptacle 40 and the reservoir 52 to prevent evaporation of the liquid additive held in the reservoir.

Figure 9:
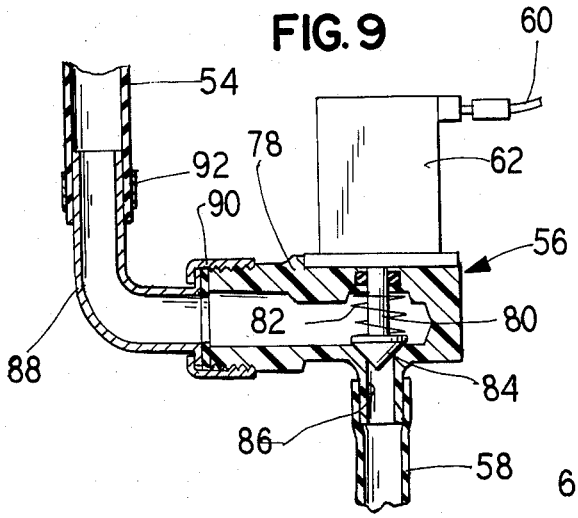
FIG. 9 is a sectional view of the metering valve apparatus.

FIG. 9 shows the metering valve 56 in detail where it is seen that the valve 56 includes a valve body 78 on which the solenoid 62 is mounted. The solenoid has a downwardly extending plunger 80 which is biased by means of a spring 82 to be constantly extended downwardly so that a plunger head 84 will sealingly engage in a passage 86 which communicates with the conduit 58 to prevent fluid flow through the passage 86. When the solenoid is energized, the plunger 80 is retracted upwardly against the force of the spring 82, thus disengaging the plunger head 84 from the passage 86, thereby allowing fluid to pass through the passage 86 to the conduit 58.

Operation of the solenoid 62 is controlled by a conventional timer 18*a* which is also used to control the heater 29 and motor 30. The controls 18 may also include a user operable switch to enable or disable the signal to the solenoid, thereby allowing the user to selectively determine whether additive should be dispensed to a particular clothes load.

The conduit 54 from the reservoir slides over an adapter 88 which is sealingly secured to the valve body 78 by appropriate fastening means such as a sealing nut 90. The conduit 54 can be secured to the adapter 88 by means of a restraining strap 92. The interior of the adapter 88 as well as the valve body 78 are open to provide communication with the passage 86 when the plunger 80 is retracted.

The dispenser 42 can be used on a dryer having a solid state, computer based control or on a dryer having a conventional electromechanical timer. Because solid state controls permit precise timing of relatively short time intervals, they allow the use of a simple solenoid valve for accurate metering of a small charge of fluid additive. Alternatively, if a conventional electromechanical timer is used, it will be necessary to maintain the valve open for a period on the order of one minute, in which case a small flow control orifice would have to be used in association with the valve to limit the quantity of fluid dispensed. With either type of timer, a user operable switch could be provided to permit the user to select whether or not a dispensing action will be provided once the dryer is turned on. This switch would, preferably, be part of the controls 18. The construction and operation of either type of dryer control itself is not a part of the present invention, as it is deemed well within the skill of the art to provide the required timing signals and selector switch.

Various types of non-viscous anti-static and/or fabric softening agents can be used with the dispenser. By way of example, Sears Laundry Detergent and Fabric Softener, catalog No. 119361, can be used. A material available from the DeSoto Chemical Co., identified as DeSoto Dryer Added Softener No. 3557-19-1 can also be used with good results.

The dispenser 42 is designed for use with a concentrated additive solution, so that only a small amount of solution (e.g., approximately 3 grams) is required for each drying operation. The amount of solution required and the rate at which the solution is transferred to the clothes load depends primarily on the composition and construction of the wick member.

The wool felt wick member described above and used in a prototype dispenser can absorb and retain the entire quantity of additive to be dispensed. It is not, however, absolutely necessary that the wick member 66 have this amount of absorption capability. While it takes about two seconds for the wick to absorb the metered quantity of additive, it takes many minutes for the additive to be substantially completely transferred to the clothes load as the clothes tumble within the dryer and periodically engage the wick to absorb the fluid additive held therein. This relatively slow transfer of the additive to the clothes load is highly desirable, as it results in a more uniform application of the additive to the clothes.

Therefore, it is seen that the present invention provides a built-in, multiple use dispenser for an automatic clothes dryer. The fixed dispenser is positioned to contact the clothes load during the drying operation and means are provided for supplying a charge of fluid additive to the dispensing member during operation of the dryer. The dispenser utilizes a porous, wick-like body of material which is mounted to the fixed bulkhead within the dryer, the wick member having a first surface portion which is exposed to the clothes load in a second surface portion which is arranged to be contacted by a liquid additive, and means are provided for selectively supplying a measured quantity of the liquid additive to the second surface.

The advantages provided by the present invention are that there is a simple, inexpensive construction for metering and dispensing small amounts of fluid additive to the dryer and, once filled, the additive dispenser provides many operations without the need for any action on the part of the appliance user (other than possibly operating a switch to enable or disable the timing signal for the dispenser). A full quantity of additive is applied to each clothes load whenever the user has selected the dispensing operation with the cycle.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a fabric drying apparatus having a drum arranged for rotation about a generally horizontal axis and a non-rotating bulkhead member, a fluid additive dispenser comprising:

a body of porous material comprising a pad with at least one flat surface mounted to said bulkhead member within said drum;

said material having a first surface portion exposed to the interior of said drum and a second surface position for receiving the fluid additive, said first surface portion being said flat surface; and means for selectively supplying a predetermined quantity of the fluid additive to the second surface;

whereby a fabric load within the dryer drum will contact said first surface of said porous material during a drying operation and thereby gradually absorb said fluid additive from said material.

2. A fabric drying apparatus according to claim 1 wherein said means for supplying said additive to said second surface comprises:

a reservoir for storing a quantity of said additive;

an opening communicating with said reservoir for filling said reservoir;

a conduit connecting said reservoir with said second surface of said material; and a valve means in said conduit for selectively metering said fluid to said material.

3. A fabric drying apparatus according to claim 1, wherein said material is retained in a holder which is in turn mounted to said bulkhead member.

4. A fabric drying apparatus according to claim 3, wherein said material comprises a disk-shaped pad, said first surface comprising a circular surface of said pad.

5. A fabric drying apparatus according to claim 4, wherein a peripheral edge of said disk is recessed slightly in said holder to prevent abrasion of said edge.

6. A fabric drying apparatus according to claim 1, further including a reservoir for storing a quantity of fluid additive and conduit means connecting said reservoir with said second surface portion of said material.

7. A fabric drying apparatus according to claim 6 wherein said selective supply means comprises a valve means interposed within said conduit means and selectively operable to deliver a predetermined quantity of fluid to said second surface of said material.

8. A fabric drying apparatus according to claim 1 wherein said body of porous material is capable of absorbing and retaining said predetermined quantity of fluid additive for gradual transfer of said additive to said fabric load during a drying operation.

9. A fabric drying apparatus comprising:

a rotating drum defining a drying chamber for receiving a fabric load to be dried;

a dispenser means fixed within the interior of said drying chamber for dispensing a fluid onto said fabric load;

said dispenser means comprising a holder mounted to a non-rotating bulkhead member in said drying chamber and a pad of porous material held in said holder, said material having a first flat surface portion exposed to the interior of said drum and a second surface portion for receiving said liquid additive, and means for supplying a charge of fluid additive to said dispensing means during operation of said drying apparatus.

10. A fabric drying apparatus according to claim 9 wherein said supply means comprises a valve means interposed within said conduit means and selectively operable to deliver a predetermined quantity of fluid to said second surface of said material.

11. A fabric drying apparatus according to claim 9 wherein said means for supplying a charge of fluid additive operates automatically during the early portion of a drying operation.

12. In a clothes dryer having a rotatable drum, means for rotating said drum about a horizontal axis, and a non-rotating rear bulkhead, a fluid additive dispenser comprising:

a reservoir for storing a quantity of said fluid additive;

dispenser means mounted on said bulkhead for dispensing said fluid additive onto a clothes load during a drying cycle;

said dispenser means comprising a holder mounted through said bulkhead and a pad of porous material held in said holder, said material having a first flat surface portion exposed to the interior of said drum and a second surface portion for receiving the liquid additive;

conduit means connecting said reservoir with said dispenser;

valve means in said conduit for selectively metering a predetermined quantity of said fluid to said dispenser.

13. A clothes dryer according to claim 12, wherein a horizontal cross section of said reservoir is substantially greater than a horizontal cross section of said conduit means, whereby a relatively constant fluid head is maintained at said valve means.

14. A clothes dryer according to claim 13, wherein means are provided for controlling the period during which said valve means is open, whereby effective controlled metering of the fluid through said valve is achieved.

15. A clothes dryer according to claim 12, wherein said reservoir has an inlet which is selectively sealable with a removable plug.

16. In a clothes dryer having a rotatable drum, means for rotating said drum about a horizontal axis, and a non-rotating rear bulkhead, a fluid additive dispenser comprising:

dispenser means mounted on said bulkhead for dispensing said additive onto a clothes load during a drying cycle;

said dispenser means comprising a holder mounted through said bulkhead and a pad of porous material held in said holder;

said material having a first flat surface portion exposed to the interior of said drum and a second surface portion for receiving the liquid additive;

a reservoir for storing a quantity of said fluid additive;

said reservoir being positioned above said dispenser whereby said fluid is caused to flow from said reservoir to said dispenser by gravity;

conduit means connecting said reservoir with said dispenser;

valve means in said conduit for selectively metering a predetermined quantity of said additive to said dispenser;

said reservoir having a horizontal cross section substantially greater than a horizontal cross section of said conduit to provide a relatively constant fluid head at said valve means.

17. A clothes dryer according to claim 16 wherein said valve means operates automatically upon operation of said dryer.

18. In a clothes dryer having a rotatable drum, means for rotating said drum about a horizontal axis, and a non-rotating rear bulkhead, a fluid additive dispenser comprising:

dispenser means mounted on said bulkhead for dispensing said additive onto a clothes load during a drying cycle;

said dispenser means comprising a holder mounted through said bulkhead and a body of porous material held in said holder;

said body of porous material comprising a disk-shaped pad of wool felt;

said material having a first surface portion exposed to the interior of said drum and a second surface portion for receiving the liquid additive;

a reservoir for storing a quantity of said fluid additive;

said reservoir being positioned above said dispenser whereby said fluid is caused to flow from said reservoir to said dispenser by gravity;

conduit means connecting said reservoir with said dispenser;

valve means in said conduit for selectively metering a predetermined quantity of said additive to said dispenser;

said reservoir having a horizontal cross section substantially greater than a horizontal cross section of said conduit to provide a relatively constant field head at said valve means.

* * * * *